US010384370B2

(12) United States Patent
Wallgren et al.

(10) Patent No.: US 10,384,370 B2
(45) Date of Patent: Aug. 20, 2019

(54) LEVEL MONITORING OF BULK MATERIAL BIN WITH HEATER CONTROL FUNCTION

(71) Applicants: Erik Wallgren, King (CA); Mark Wallgren, King (CA)

(72) Inventors: Erik Wallgren, King (CA); Mark Wallgren, King (CA)

( * ) Notice: Subject to any disclaimer, the term of this patent is extended or adjusted under 35 U.S.C. 154(b) by 976 days.

(21) Appl. No.: 14/617,353

(22) Filed: Feb. 9, 2015

(65) Prior Publication Data

US 2015/0298352 A1 Oct. 22, 2015

Related U.S. Application Data

(60) Provisional application No. 61/937,082, filed on Feb. 7, 2014, provisional application No. 61/969,555, filed on Mar. 24, 2014.

(51) Int. Cl.

| | |
|---|---|
| ***B28C 7/00*** | (2006.01) |
| ***B28C 7/02*** | (2006.01) |
| *F26B 21/06* | (2006.01) |
| *F26B 21/10* | (2006.01) |

(52) U.S. Cl.

CPC ..... *B28C 7/003* (2013.01); *B28C 7/02* (2013.01); *F26B 21/06* (2013.01); *F26B 21/10* (2013.01)

(58) Field of Classification Search

CPC ..... B28C 7/003; B28C 7/02; B22F 1/0085; F26B 21/06; F26B 21/10; E01C 19/08

USPC ..... 432/215

See application file for complete search history.

(56) References Cited

U.S. PATENT DOCUMENTS 2,451,024 A * 10/1948 Ellerbeck ..... C04B 2/12 222/267
2,506,545 A * 5/1950 Crowley, Jr. ..... B01J 20/08 208/169
2,543,005 A * 2/1951 Evans ..... C07C 2/00 196/121
2,548,522 A * 4/1951 Drew ..... B01J 8/12 208/169
2,563,323 A * 8/1951 Grossman ..... F28C 3/14 432/215
2,613,924 A * 10/1952 Drew ..... F28F 9/00 208/165
2,614,824 A * 10/1952 Weber ..... F28C 3/14 165/104.18
2,620,175 A * 12/1952 Weber ..... F28C 3/14 208/165

(Continued)

*Primary Examiner* — Avinash A Savani
*Assistant Examiner* — Martha M Becton
(74) *Attorney, Agent, or Firm* — Ryan W. Dupuis; Ade & Company Inc.; Kyle R. Satterthwaite

(57) ABSTRACT

An aggregate bin heater assembly having a bin for receiving aggregate therein and a plurality of fluid inlets supported at vertically spaced apart elevations relative to the bin for distributing a heating fluid into the aggregate within the bin, further includes a control system for controlling distribution of the heating fluid. A pressure sensor associated with at least an uppermost one of the fluid inlets so as to be arranged to sense pressure within the bin at the respective elevation. A controller determines a low pressure condition if the pressure sensed by the pressure sensor is lower than a prescribed normal pressure. A valve associated with the uppermost one of the fluid inlets shuts off the flow of heating fluid to the uppermost one of the fluid inlets responsive to determination of the low pressure condition by the controller.

18 Claims, 3 Drawing Sheets

(56) References Cited

U.S. PATENT DOCUMENTS 2,630,413 A * 3/1953 Weber ..... F28C 3/14 422/223
2,639,215 A * 5/1953 Bland ..... B01J 8/12 208/165
2,968,874 A * 1/1961 Fishburn ..... F26B 17/106 236/84
3,140,154 A * 7/1964 Thompson ..... C01B 21/32 422/111
3,511,375 A * 5/1970 Lang ..... B03B 5/623 209/454
3,659,583 A * 5/1972 Martin ..... B28C 7/003 126/343.5 A
3,831,668 A * 8/1974 Weissenburg ..... F28C 3/14 165/104.18
3,920,159 A * 11/1975 Vaananen ..... B28C 7/003 222/146.2
3,953,190 A * 4/1976 Lange ..... C03B 3/023 65/335
3,982,886 A * 9/1976 Christiansen ..... B01D 53/68 432/106
4,002,421 A * 1/1977 Summer ..... F27B 1/005 432/19
5,351,725 A * 10/1994 Suthergreen ..... G01F 1/007 141/1
5,365,555 A * 11/1994 Sawabe ..... G21C 17/035 376/247
5,454,938 A * 10/1995 Doyle ..... B01J 8/1809 210/106
2008/0066340 A1* 3/2008 Kakuno ..... F26B 5/04 34/489
2010/0205821 A1* 8/2010 Tada ..... B01D 53/06 34/428
2015/0025817 A1* 1/2015 Ten Kate ..... A61B 5/1117 702/50

* cited by examiner

LEVEL MONITORING OF BULK MATERIAL BIN WITH HEATER CONTROL FUNCTION

This application claims the benefit under 35 U.S.C. 119(e) of U.S. provisional application Ser. No. 61/937,082, filed Feb. 7, 2014, and U.S. provisional application Ser. No. 61/969,555, filed Mar. 24, 2014.

FIELD OF THE INVENTION

The present invention relates to a system for monitoring pressure of a fluid percolated through a bulk material within a particulate material storage bin, for example in one embodiment the system may measure the pressure of a flow of conditioning fluid such as heated air which is pressurized to flow through the aggregate to be conditioned in the bin. In an alternative embodiment the system may measure the pressure level of a pressurized flow of an auxiliary fluid such as compressed air which flows through the particulate material in the bin, whereby a loss in back pressure in the flow of the fluid is indicative of an absence of material at the monitored elevation. The monitored pressure thus permits a height of the particulate material within the bin to be monitored, and in the instance of an aggregate conditioning bin also permits the flow of conditioning fluid injected into the aggregate to be controlled to prevent wasteful distribution of conditioning fluid to upper portions of the bin whenever the level of the material inside the bin is lower than the level at which the heating fluid is injected.

BACKGROUND

In colder climates, where aggregate is often stored below freezing temperatures, it is generally known to heat aggregate to ensure that water does not freeze in contact with the aggregate when mixing with concrete.

A known type of aggregate heater is an air heated bin in which a bin structure having an open top end for loading and a hopper at a bottom end for discharge further includes a plurality of fluid inlets at different elevations for diffusing the hot air through the aggregate in the bin. One example of a bin heater system of this arrangement is described in U.S. Pat. No. 3,659,583 by Martin.

In a typical aggregate condition bin, the level of material in the bin is highly variable since the feeding of material to the bin and the consumption of the material from the bin are not constant and equal rates. When using known heater systems of the type described above, air follows the path of least resistance through the aggregate. Accordingly, if the variable level of aggregate material within the bin falls below the uppermost fluid inlets, the heated air primarily escapes to atmosphere through the exposed fluid inlets rather than being used effectively to heat the aggregate.

It is also desirable to keep the bin close to being full for optimal use of the heated air, but few reliable means are known for monitoring the height of the entire top surface of the aggregate in the bin.

SUMMARY OF THE INVENTION

According to one aspect of the invention there is provided a control system for an aggregate conditioning bin assembly having a bin for receiving aggregate therein and a plurality of fluid inlets supported at vertically spaced apart elevations relative to the bin for distributing a conditioning fluid into the aggregate within the bin, the control system comprising:

a height monitor arranged to determine if height of the aggregate is below one or more fluid inlets of the uppermost elevation;

a controller arranged to determine a low level condition if said height is below the one or more fluid inlets of the uppermost elevation;

a valve associated with the one or more fluid inlets of the uppermost elevation so as to be arranged to shut off a flow of conditioning fluid to the one or more fluid inlets of the uppermost elevation responsive to determination of the low level condition by the controller.

According to second aspect of the invention there is provided a control system for an aggregate bin heater assembly having a bin for receiving aggregate therein and a plurality of fluid inlets supported at vertically spaced apart elevations relative to the bin for distributing a heating fluid into the aggregate within the bin, the control system comprising:

a pressure sensor associated with an uppermost one of the fluid inlets so as to be arranged to sense pressure of the heating fluid within the bin at the respective elevation;

a controller arranged to determine a low pressure condition if the pressure sensed by the pressure sensor is lower than a prescribed normal pressure;

a valve associated with the uppermost one of the fluid inlets so as to be arranged to shut off a flow of heating fluid to the uppermost level of the fluid inlets responsive to determination of the low pressure condition by the controller.

By monitoring the pressure of at least an uppermost elevation in particulate material storage bin equipped with fluid inlets at different elevations, the drop in back pressure resulting from an absence of particulate material at the elevation being monitored by any pressure sensor can be used both i) to monitor height of the particulate material within the bin, as well as ii) in the case of an aggregate condition bin, to cease flow of conditioning fluid to elevations not occupied by aggregate for optimizing efficiency of the conditioning system.

Preferably the prescribed normal pressure corresponds to a pressure indicative of a height of the aggregate being above said uppermost one of the fluid inlets. Typically the prescribed normal pressure is based upon ambient pressure.

The system preferably further includes at least one secondary sensor associated with another respective one of the fluid inlets so as to be arranged to sense pressure of the heating fluid at the respective elevation. A valve is preferably also arranged to be in communication with the associated fluid inlet of said at least one secondary sensor so as to be arranged to shut off a flow of heating fluid to that fluid inlet responsive to determination of a low pressure condition associated with that fluid inlet.

When the system further includes a pressure tube extending between a first end arranged to communicate with the heating fluid in the aggregate within the bin at the respective elevation of the uppermost one of the fluid inlets and a second end which is external of the bin, the pressure sensor is preferably in communication with the second end of the pressure tube.

Each fluid inlet preferably communicates with a diffuser element extending generally horizontally through the bin. Preferably the first end of the pressure tube is arranged to communicate with the heating fluid within the diffuser element.

The heating fluid typically comprises air, however, the heating fluid may alternatively be conditioning fluid such as steam or air with a prescribed moisture content.

Each pressure sensor is preferably arranged to sense pressure of the heating fluid within the bin at the respective elevation.

According to a further aspect of the present invention there is provided a height monitoring system for an aggregate storage bin arranged for receiving aggregate therein, the system comprising:

a plurality of fluid inlets arranged to be supported at vertically spaced apart elevations relative to the bin for distributing a pressurized fluid into the aggregate within the bin;

a pressure sensor associated with at least one of the fluid inlets so as to be arranged to sense pressure of the pressurized fluid within the bin at the respective elevation; and a controller arranged to determine a low pressure condition of said at least one fluid inlet if the pressure sensed by the pressure sensor of said at least one fluid inlet is lower than a prescribed normal pressure;

whereby a height of the aggregate is determined to be below said at least one fluid inlet responsive to a determination of the low pressure condition of said at least one fluid inlet.

The pressure sensor of said at least one fluid inlet is preferably arranged to sense pressure of the pressurized fluid within the fluid inlet prior to the fluid entering the aggregate.

Preferably said at least one fluid inlet includes at least one diffuser element spanning horizontally across the bin such that said at least one diffuser element communicates with aggregate in the bin at various locations across the respective elevation of the fluid inlet. Preferably the pressure sensor is arranged to sense pressure within said at least one diffuser element.

Preferably the diffuser elements are shaped to prevent accumulation of the aggregate thereon by being open only in a generally downward direction into the bin.

Preferably the pressurized fluid is introduced into the diffuser element at a location which is horizontally spaced apart from a sensing location which is in communication with the pressure sensor.

The pressurized fluid typically comprises a compressible fluid, however, a non-compressible conditioning fluid may be used in some instances.

In some embodiments, a pressure sensor is associated with one fluid inlet at each respective elevation of the bin.

Preferably said at least one of the fluid inlets is arranged such that pressurized fluid is introduced into the fluid inlet at a supply location which is horizontally spaced apart from a sensing location which is in communication with the pressure sensor and such that the fluid inlet is in communication with the aggregate between the supply location and the sensing location.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
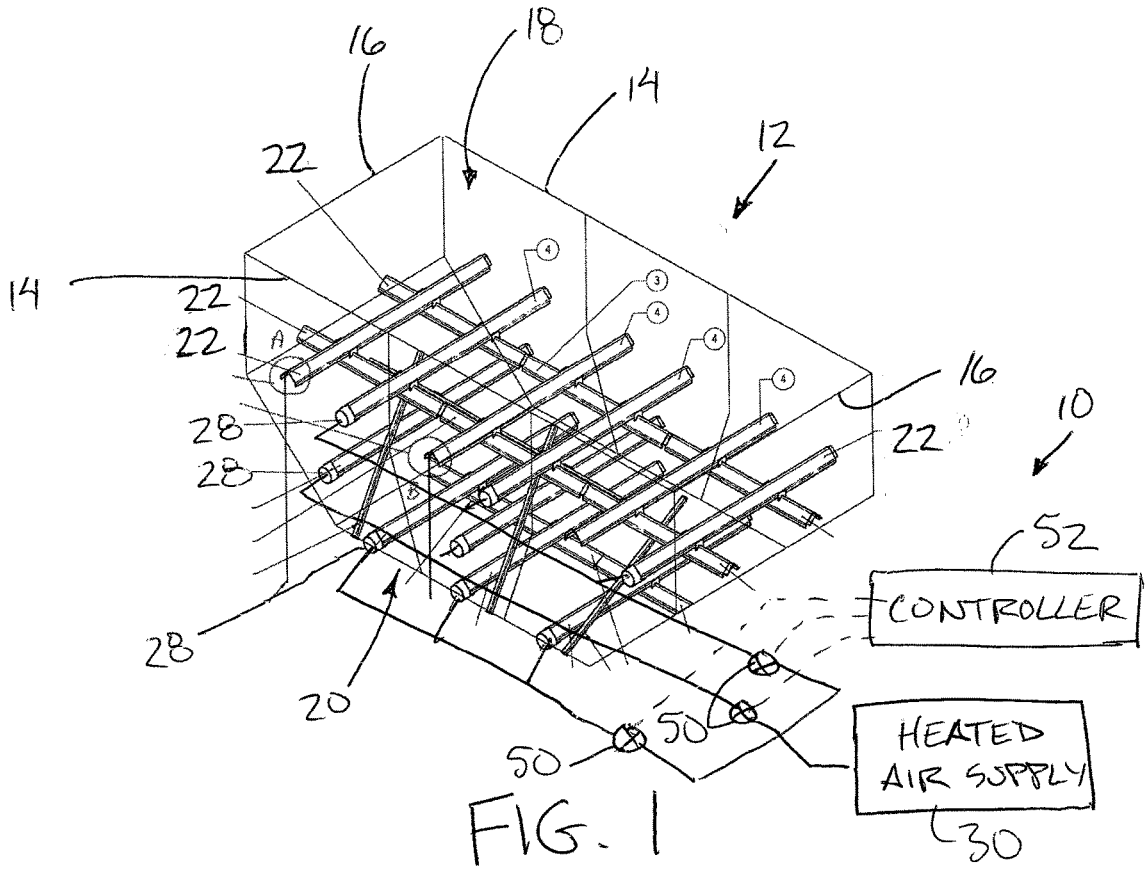
FIG. 1 is a perspective view of the control and monitoring system applied to a heater bin.
Figure 2:
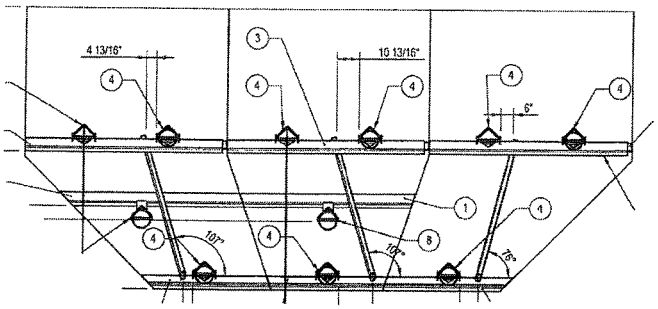
FIG. 2 is a side elevational view of the bin according to FIG. 1.
Figure 3:
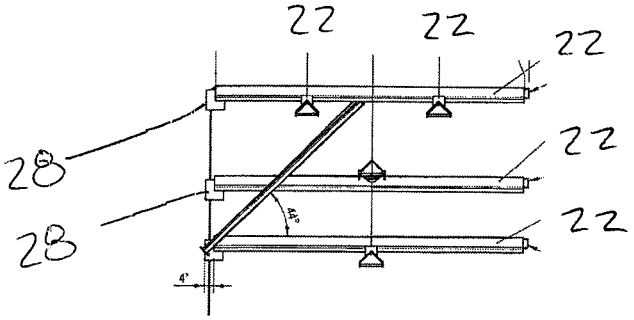
FIG. 3 is an end elevational view of the diffuser arrangement in the bin according to FIG. 1.
Figure 4:
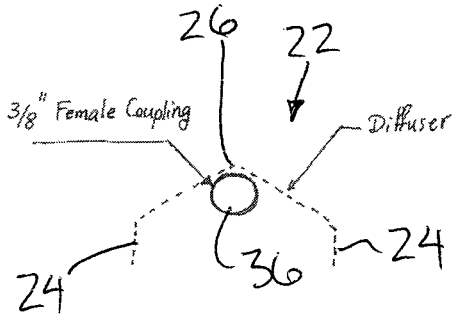
FIG. 4 is an end elevation view of one of the diffuser elements in the bin according to FIG. 1 with one of the pressure ports in the bin wall shown in relation to the diffuser element.
Figure 5:
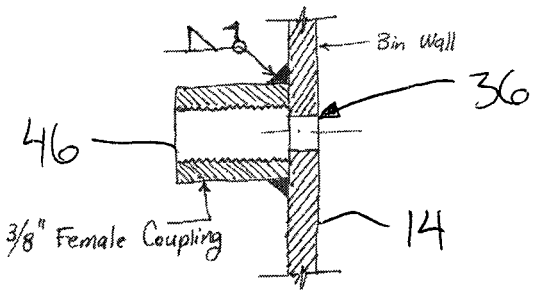
FIG. 5 is a cross sectional view through one of the pressure ports in the bin wall.
Figure 6:
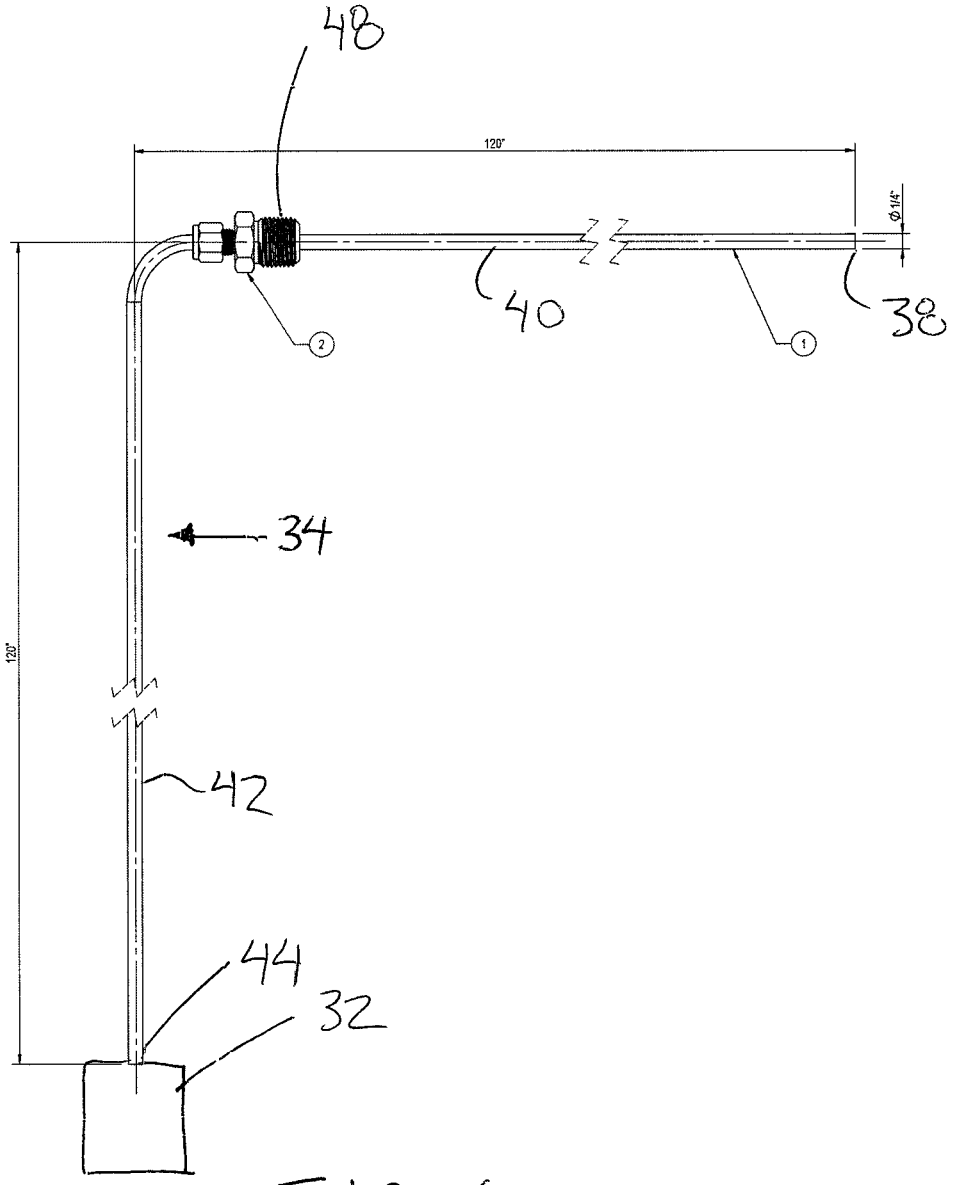
FIG. 6 is an elevational view of a pressure tube and fitting for threaded connection within one of the pressure ports in the bin wall.

Referring to the accompanying figures, there is illustrated an aggregate bin control and monitoring system generally indicated by reference numeral 10. The system 10 is particularly suited for use with an aggregate heater bin 12.

In the illustrated embodiment, the bin 12 includes two upright side walls 14 and two end walls 16 joined between the side walls at longitudinally opposed ends. In this manner, the walls define a full perimeter containment spanning between an open top end 18 of the bin through which aggregate may be loaded to a bottom end 20 locating a hopper with a gate mechanism to control the discharge of aggregate therethrough.

The bin further includes a plurality of diffuser elements 22 spanning horizontally across the bin at each of three different elevations. At each elevation, at least one diffuser element 22 extends longitudinally between the two end walls 16 and a plurality of diffuser elements 22 span laterally between the opposing two side walls 14, perpendicularly across the longitudinal diffuser elements.

Each diffuser element 22 comprises a rigid elongate channel which is formed by bending a flat plate and which is inverted in orientation. Accordingly, each channel defines two depending side flanges 24 and a bridge portion 26 connected between the top ends of the side flanges such that the resulting diffuser element remains open along the bottom thereof along the full length between opposing walls of the bin.

The bridge portion is formed with an apex with the remainder of the diffuser element being sloped downwardly therefrom to prevent accumulation of any material on the diffuser elements. The downwardly open arrangement of the diffuser elements also prevents accumulation of any material within the diffuser elements.

At each elevation, all of the diffuser elements of that elevation communicate with one another so that the diffuser elements collectively communicate with the surrounding material at various locations as a common diffuser network spanning across the bin at the respective elevation. One end of one or more diffuser elements of each diffuser network at a respective bin level communicates with a fluid inlet port 28 formed as a port communicating through the corresponding wall of the bin.

All of the fluid inlet ports 28 are supplied with a pressurized flow of conditioning fluid, for example heater air supplied by a heated air supply 30 in the instance of a heater bin. In the instance of other conditioning bins, for example for drying aggregate, the pressurized flow of conditioning fluid may take the form of compressed air for drying the aggregate.

In this manner, when the bin is full and a heating cycle is activated, air is heated and distributed under pressure by a blower of the heated air supply 30 through a suitable manifold structure to be injected into the bin through the various ports. The flow of heated air extends along all of the diffuser elements of each diffuser network associated with each inlet port such that the inlet port and the associated diffuser elements collectively define the fluid inlet for the respective elevation from which the conditioning fluid is subsequently diffused into the surrounding aggregate, followed by being exhausted upwardly through the open top end of the bin.

The control and monitoring system 10 typically includes a plurality of pressure sensors 32 with at least one sensor typically being associated with each of the multiple elevations of the diffuser elements. Each pressure sensor 32 communicates with a respective pressure tube 34 which communicates between the interior of the bin and the exterior of the bin where the corresponding pressure sensor is located.

More particularly, each pressure tube 32 extends through the bin wall through a respective pressure port 36 formed in the wall. Each diffuser element having a pressure sensor associated therewith typically locates the pressure port 36 in the bin wall at a location which is horizontally opposed from the associated fluid inlet port 28. The pressure tube is arranged to extend from a first end 38 located centrally along the length of the respective diffuser element directly below the bridge portion 26. The pressure tube and the sensor communicate with the respective inlet through the one or more diffuser elements forming the associated diffuser network. The pressure tube and sensor are thus located in communication with the fluid while it still remains within the collective fluid inlet defined by the associated diffuser network at a common elevation with one another, and prior to diffusion of the fluid into the surrounding aggregate.

In this instance, each diffuser network defines a respective fluid inlet having a supply location and a sensing location which are horizontally spaced apart from one another such that fluid in the diffuser network is permitted to communicate with and diffuse into the surrounding aggregate between the supply location and the sensing location. The supply location is defined as the inlet port in the side wall of the bin where the pressurized fluid is first introduced into the diffuser network. The sensing location is defined as the first end 38 of the pressure tube of the respective pressure sensor associated with the diffuser network at the same horizontal elevation.

A first leg 40 of the tube extends horizontally from the first end 38 through the pressure port 36 for connection to a second leg 42 which extends downwardly along the outer side of the corresponding bin wall. The second leg terminates at a bottom end defining a second end 44 of the tube which is in communication with the respective pressure sensor 32.

At each pressure port 36, the bin wall includes an internally threaded socket secured to the outer side of the bin wall which defines a female coupling 46. The pressure tube includes a corresponding threaded male coupling 48 located at the end of the first leg in proximity to the second leg such that threaded connection between the male coupling 48 and the female couple 46 provides a sealed connection of the pressure tube 34 relative to the pressure port 36 receiving the tube therethrough.

Each level has one or more valves 50 associated therewith which are in communication in series between the heated air supply and all of the fluid inlet ports of the associated level. The valves are arranged to be opened and closed under control of a suitable controller 52.

The controller 52 functions to monitor pressure from all of the sensors 32. The controller determines a normal prescribed pressure corresponding to the back pressure of heated air when the bin is full of aggregate. The normal prescribed pressure will be different for each different type of aggregate received in the bin as the resistance to the diffusion of the heated air upwardly through the aggregate to the open top of the bin will be different depending upon the size of the aggregate and thus the corresponding size of interspaces between particles of the aggregate.

Once a normal prescribed pressure has been calibrated for the aggregate type located in the bin, the controller then continues to monitor the pressure from all sensors to determine if any low pressure conditions occur. The low pressure condition is determined when the monitored pressure of one of the sensors falls below the normal prescribed pressure by a lower limit or threshold amount. This is normally indicative of a situation where the level of aggregate in the bin falls below the elevation of the fluid inlets or diffusers monitored by one of the pressure sensors such that the resulting back pressure to the flow of heated air diffusing through the aggregate is reduced. Typically the normal prescribed pressure is derived from a measured ambient pressure.

Height is determined by the controller to be below any sensor which is found to be in a low pressure condition.

Furthermore, when a low pressure condition is determined at any monitored elevations of the bin, the controller actuates the corresponding valves to shut off the flow of heated air to all of the diffusers and fluid inlet ports associated with that elevation and any elevation thereabove to prevent the wasteful escape of heated air above the level of aggregate within the bin.

In further embodiments, the control and monitoring system can be adapted for various other heated fluids including steam and the like.

Furthermore, in some embodiments, only an uppermost elevation of fluid inlets may be monitored by pressure sensors to indicate that the bin requires filling above the uppermost level. Provided that the bin is maintained at a reasonable level in response to the indication by the monitoring system whenever the bin level falls below the uppermost level, additional elevations below the uppermost diffuser element may not be required to be monitored.

In yet further embodiments, the system 10 may be used only as a height monitor in any type of particulate material storage bin, for example aggregate, plastics, grains, etc. simply by modifying the bin to provide vertically spaced apart pressure ports along one or more walls of the bin. In this instance the pressure ports communicate with pressure sensors monitored by a controller as described above and the different elevations are supplied with a flow of pressurized air such that the back pressure in the flow to each level is monitored.

The control and monitoring system 10 is further adaptable to various sizes and configurations of bins as well as to various configurations of conditioning systems which supply a conditioning fluid at one or more elevations.

Various modifications can be made in my invention as herein above described, and many apparently widely different embodiments of same made without department from the spirit and scope of the invention. It is intended that all matter contained in the accompanying specification shall be interpreted as illustrative only and not in a limiting sense.

The invention claimed is:

1. An aggregate conditioning bin assembly comprising:

a bin receiving aggregate therein;

a plurality of fluid inlets supported at vertically spaced apart elevations relative to the bin in which each elevation has one or more of the fluid inlets associated therewith;

a source of aggregate conditioning fluid in communication with the fluid inlets;

a valve in connection between the source of aggregate conditioning fluid and the one or more fluid inlets of an uppermost elevation of the elevations so as to be arranged to selectively shut off a flow of the aggregate conditioning fluid from the source to the one or more fluid inlets of the uppermost elevation;

a height monitor comprising a pressure sensor associated with said uppermost elevation so as to be arranged to sense pressure within the bin at the respective uppermost elevation; and a controller arranged to compare pressure sensed by the pressure sensor to a prescribed normal pressure and determine a low pressure condition indicative that the height of the aggregate is below the uppermost level if the pressure sensed by the pressure sensor at the uppermost level is lower than a prescribed normal pressure;

the controller being further arranged to close the valve connected to the one or more fluid inlets of the uppermost elevation in response to determination of the low pressure condition of the pressure sensor associated with the uppermost elevation.

2. The assembly according to claim 1 wherein the aggregate conditioning fluid comprises a heating fluid.

3. The assembly according to claim 2 in combination with the heating fluid in which the heating fluid comprises heated air.

4. The assembly according to claim 2 in combination with the heating fluid in which the heating fluid comprises either steam or air with moisture.

5. The assembly according to claim 2 wherein the pressure sensor is arranged to sense pressure of the heating fluid within the bin at the respective elevation.

6. The assembly according to claim 2 wherein the pressure sensor of said uppermost fluid inlet is arranged to sense pressure of fluid within the fluid inlet prior to the fluid entering the aggregate.

7. The assembly according to claim 1 further comprising at least one secondary sensor associated with another respective one of the fluid inlets so as to be arranged to sense pressure of the heating fluid at the respective elevation.

8. The assembly according to claim 7 further comprising a valve arranged to be in communication with the associated fluid inlet of said at least one secondary sensor so as to be arranged to shut off a flow of heating fluid to that fluid inlet responsive to determination of a low pressure condition associated with that fluid inlet.

9. The assembly according to claim 1 further comprising a pressure tube extending between a first end arranged to communicate with the heating fluid in the aggregate within the bin at the respective elevation of the uppermost fluid inlet and a second end which is external of the bin, the pressure sensor being in communication with the second end of the pressure tube.

10. The assembly according to claim 9 wherein each fluid inlet communicates with a diffuser element extending generally horizontally through the bin and wherein the first end of the pressure tube is arranged to communicate with the heating fluid within the diffuser element.

11. The assembly according to claim 10 wherein said at least one diffuser element communicates with aggregate in the bin at various locations across the respective elevation of the fluid inlet, and wherein the pressure sensor is arranged to sense pressure within said at least one diffuser element.

12. The assembly according to claim 10 wherein the diffuser elements are shaped to prevent accumulation of the aggregate thereon.

13. The assembly according to claim 10 wherein said at least one diffuser element is open generally downwardly into the bin so as to prevent accumulation of the aggregate therein.

14. The assembly according to claim 10 wherein said at least one diffuser element is arranged such that pressurized fluid is introduced into the diffuser element at a location which is horizontally spaced apart from a sensing location which is in communication with the pressure sensor.

15. The assembly according to claim 1 wherein the prescribed normal pressure corresponds to a pressure indicative of a height of the aggregate being above said uppermost inlet.

16. The assembly according to claim 1 wherein the prescribed normal pressure is based upon ambient pressure.

17. The assembly according to claim 1 further comprising a pressure sensor associated with one fluid inlet at each respective elevation of the bin.

18. The assembly according to claim 1 wherein said uppermost fluid inlet is arranged such that pressurized fluid is introduced into the fluid inlet at a supply location which is horizontally spaced apart from a sensing location which is in communication with the pressure sensor and wherein the fluid inlet is in communication with the aggregate between the supply location and the sensing location.

* * * * *